US008669903B2

(12) United States Patent
Thill et al.

(10) Patent No.: US 8,669,903 B2
(45) Date of Patent: Mar. 11, 2014

(54) DUAL FREQUENCY BAND COMMUNICATION ANTENNA ASSEMBLY HAVING AN INVERTED F RADIATING ELEMENT

(75) Inventors: Kevin M. Thill, Scottsdale, AZ (US); William J. Liimatainen, Monroe, WI (US)

(73) Assignee: Antenna Plus, LLC, Scottsdale, AZ (US)

( * ) Notice: Subject to any disclaimer, the term of this patent is extended or adjusted under 35 U.S.C. 154(b) by 706 days.

(21) Appl. No.: 12/942,340

(22) Filed: Nov. 9, 2010

(65) Prior Publication Data

US 2012/0112964 A1 May 10, 2012

(51) Int. Cl.
*H01Q 1/38* (2006.01)
*H01Q 1/32* (2006.01)

(52) U.S. Cl.
USPC ..... 343/700 MS; 343/713

(58) Field of Classification Search
USPC ..... 343/700 MS
See application file for complete search history.

(56) References Cited

U.S. PATENT DOCUMENTS

| | | | | |
|---|---|---|---|---|
| 4,089,003 | A | 5/1978 | Conroy | |
| 4,305,078 | A | 12/1981 | Jones, Jr. et al. | |
| 4,329,689 | A | 5/1982 | Yee | |
| 4,401,988 | A | 8/1983 | Kaloi | |
| 5,041,838 | A | 8/1991 | Liimatainen et al. | |
| 5,121,127 | A | 6/1992 | Toriyama | |
| 5,323,168 | A | 6/1994 | Itoh et al. | |
| 5,438,338 | A | 8/1995 | Thill | |
| 5,568,155 | A | 10/1996 | Tsunekawa et al. | |
| 5,801,660 | A | 9/1998 | Ohtsuka et al. | |
| 6,087,990 | A | 7/2000 | Thill et al. | |
| 6,850,191 | B1 * | 2/2005 | Thill et al. | 343/700 MS |
| 2003/0122718 | A1 * | 7/2003 | Fang et al. | 343/702 |
| 2003/0231134 | A1 * | 12/2003 | Yarasi et al. | 343/700 MS |
| 2005/0134520 | A1 * | 6/2005 | Rawat et al. | 343/873 |
| 2008/0231521 | A1 * | 9/2008 | Anguera Pros et al. | 343/702 |

* cited by examiner

*Primary Examiner* — Dameon Levi
*Assistant Examiner* — Graham Smith
(74) *Attorney, Agent, or Firm* — Quarles & Brady LLP; George E. Haas

(57) ABSTRACT

A dual frequency band antenna has a first section with a dielectric material separating parallel first and second conductive layers. An electrical shunt extends between the first and second electrically conductive layers. A second section includes an inverted F element electrically connected to the second electrically conductive layer. A transmission medium carries signals between the antenna assembly and a communication circuit and has a first electrical conductor connected to the first electrically conductive layer and a second electrical conductor connected to the inverted F element.

19 Claims, 1 Drawing Sheet

DUAL FREQUENCY BAND COMMUNICATION ANTENNA ASSEMBLY HAVING AN INVERTED F RADIATING ELEMENT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to antennas for two-way communication, such as radio equipment in vehicles and mobile telephones, and more particularly to planar antennas for such applications.

2. Description of the Related Art

Computers, data terminals, and other electronic equipment in vehicles, such as police cars, employ radios to exchange data and other information with base stations. For example, cellular telephone networks and WIFI Internet connections are commonly used for communication with such mobile equipment. The radio system that links the mobile electronic equipment to the telephone network or the Internet has an antenna on the exterior of the vehicle to send and receive the radio frequency signals. Cellular telephones transmit in the 824 to 845 MHz frequency band and receive signals in the 870 to 896 MHz frequency band. PCS telephones operate in the 1850 to 1990 MHz. frequency band. The WIFI protocol enables communication over different frequency bands, for example the 2.4 GHz ISM band and the 5.0 GHz U-NII band. An antenna that is tuned to operate with one of these frequency bands is not optimum for communication in another frequency band.

A typical communication antenna for a motor vehicle is attached to the exterior surface of the roof or trunk and comprises a short section of rigid wire extending vertically. Separate antennas typically are required in order to communicate on multiple frequency bands. Even though such antennas are relatively short, protruding about one foot from the surface of the vehicle, they are subject to accidental breakage, such as in automatic car washes, and acts of vandalism. These antennas are often considered to be unsightly and a detraction from the aesthetic appearance of the vehicle.

U.S. Pat. No. 5,041,838 describes a low profile, flat disk-shaped antenna for bidirectional communication, such as cellular telephones. This antenna is attached to a horizontal exterior surface of the motor vehicle, such as the roof. A coaxial cable extends through a hole in that surface, coupling the external antenna to the transceiver inside the motor vehicle. This antenna is tuned to a single frequency band.

U.S. Pat. No. 6,087,990 discloses a low profile, flat disk-shaped antenna assembly that combines two antennas into a single package. One antenna is tuned for bidirectional communication equipment, such as cellular telephones, while the other antenna in designed for another type of radio frequency equipment, such as a global positioning satellite receiver. Separate coaxial cables for each type of equipment connect to this dual antenna assembly.

U.S. Pat. No. 6,850,191 describes an antenna assembly has a pair of disk shaped antennas, each tuned to a different frequency band, thereby enabling the same assembly to be used with two different of communication apparatus. One antenna disk lies on top of the other in electrical contact. A single coaxial cable carries the signals for both antennas with one conductor of the cable attached to one antenna and the other conductor is attached to the other antenna.

SUMMARY OF THE INVENTION

An antenna assembly comprises a first antenna section and a second antenna section for transmitting and/or receiving signals in two different frequency bands.

The first antenna section includes a first electrically conductive layer extending in a first plane, a second electrically conductive layer extending in a second plane that is spaced from and parallel to the first plane, and a dielectric material between the first and second electrically conductive layers. An electrical shunt is connected to the first and second electrically conductive layers.

The second antenna section comprises an inverted F element that is electrically connected to the second electrically conductive layer. In one embodiment, the inverted F element includes a rod of electrically conductive material which has a L-shape with a first leg and a second leg that is longer than the first leg. An end of the first leg is electrically attached to the second electrically conductive layer and the second leg is parallel to the second electrically conductive layer.

A transmission medium for carrying signals between the antenna assembly and a communication circuit has first and second electrical conductors. The first electrical conductor is connected to the first electrically conductive layer and the second electrical conductor connected to the inverted F element. For example, the second electrical conductor is connected to the second leg, thereby forming the short third leg of the inverted F element.

DETAILED DESCRIPTION OF THE INVENTION

The phrase "directly connected to" as used herein means that the associated components are electrically connected together without any intervening element, other than a connector, through which electricity must flow to be conducted from one directly connected component to the other component. The term "directly connecting" means that the respective component connects two other components without any intervening element, other than a connector, through which electricity must flow.

Figure 1:
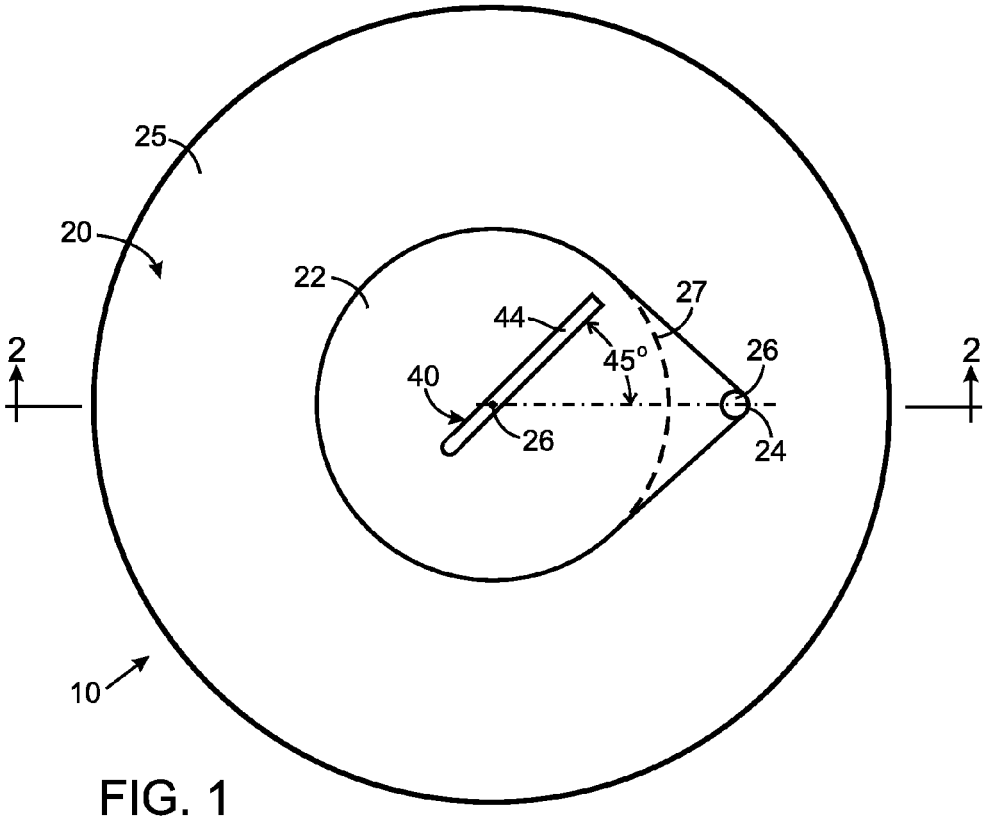
FIG. 1 is a plane view of the top of dual frequency band antenna assembly according to the present invention.
Figure 2:
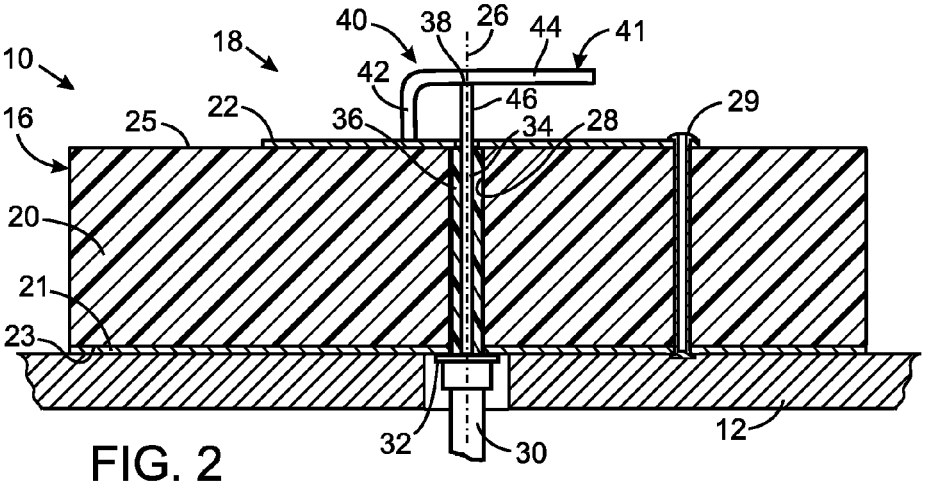
FIG. 2 is a cross sectional view along line 2-2 in FIG. 1.

With reference to FIGS. 1 and 2, a dual frequency band antenna assembly 10 is mounted on a surface of an object 12, such as a roof of a motor vehicle. The antenna assembly 10 comprises a first antenna section 16 for communication at a first frequency and a second antenna section 18 for communication at a second frequency.

The first antenna section 16 is formed with a circular disk-shaped substrate 20 of a dielectric material, such as PMI foam or a PTFE composite. The diameter of the substrate 20 is less than one-half the wavelength of the radio frequency signals which the first antenna section is to transmit and receive. Limiting the diameter in this matter prevents high order modes from being excited. For frequencies bands commonly used for WIFI transmission, the substrate 20 is 1.5 inches in diameter and 0.375 inches thick, for example.

The bottom and top flat major surfaces 23 and 25 on opposite sides of the substrate 20 are in parallel planes and have geometric centers that lie on a common axis 26. First and second conductive layers 21 and 22 are respectively mounted on the bottom and top major surfaces 23 and 25. For example, the conductive layer may be formed by brass or copper plates bonded to those major surfaces. Although the first and second conductive layers are separated by a body of dielectric material, the substrate 20 may be eliminated by separating the two conductive layers 21 and 22 by air, which also is a dielectric material. The first conductive layer 21 covers the entirety of the substrate's bottom major surface 23. The second conductive layer 22 is substantially centered on the top major surface 25 and extends over only a portion of that surface. As shown in FIG. 1, the second conductive layer 22 has a tear-drop shape with an outwardly projecting tip 24. Specifically, the second conductive layer 22 has a circular major portion 27 that is centered on the top major surface 25 of the substrate 20 and from which the tip 24 projects. Thus the second conductive layer 22 is substantially centered on the common axis 26.

For example, if the first antenna section 16 is to operate in the 2.4 GHz ISM frequency band, the substrate 20 and the first conductive layer 21 may be approximately 1.5 inches in diameter. The circular major portion 27 of the second conductive layer 22 may be 0.68 inches in diameter with the tip 24 extending approximately 0.43 inches from the center point of the major portion, which center point is on axis 26. Therefore, the flat surface area of the first conductive layer 21 is more that four times the flat surface area of the second conductive layer 22.

A conductive tuning post 29 extends through the first conductive layer 21, the dielectric substrate 20, and the tip 24 of the second conductive layer 22, thereby electrically directly connecting the first and second conductive layers. A brass or copper tuning post may be used. The tuning post 29 can be a hollow rivet with heads at both ends that are soldered to the respective conductive layer. Alternatively, the tuning post 29 may be first inserted through the substrate 20 and then the first and second conductive layers 21 and 22 deposited on the major surfaces of the substrate in electrical contact with the tuning post. One skilled in the art of antenna design will appreciate that the precise number and locations of the tuning posts are a function of the radio frequencies to be received and/or transmitted by the antenna.

An aperture 28 extends through the first antenna section 16 along the common axis 26 and thus through the centers the circular disk-shaped substrate 20 and the first and second conductive layers 21 and 22.

The second antenna section 18 is mounted on the second conductive layer 22 on the top major surface 25 of the substrate 20. The second antenna section 18 has an inverted F element 40 that includes a conductive rod 41 bent in an L-shape, thereby having a relatively short first leg 42 and a longer second leg 44. The end of the first leg 42 is affixed in electrical contact to the second conductive layer 22 offset from the common axis 26 at the center of that layer. The second leg 44 extends parallel to the plane of the second conductive layer 22 and intersects the common axis 26.

For a second antenna section 18 that operates in the 5.0 GHz U-NII band, the shorter first leg 42 may be 0.128 inches in length and attached to the second conductive layer 22 at a point 0.083 inches from the common axis 26. The longer second leg 44 may have a length of 0.350 inches. The axis of the second leg 44 can be oriented 45 degrees from a line that intersects the common axis 26 and the tuning post 29. The conductive rod 41 may be formed of copper with a diameter of 0.032 inches.

A conventional coaxial cable 30 forms a transmission medium that connects the antenna assembly 10 to a communication circuit, such as a radio transceiver. The shield conductor of the coaxial cable 30 is directly connected electrically by a connector 32 to the first conductive layer 21 on the bottom major surface 23 of the first antenna section 16. A center conductor 34 and an insulator layer 36 of the coaxial cable 30 extend into the aperture 28 in the first antenna section 16. The center conductor 34 projects through and outwardly from the second conductive layer 22 terminating at a remote end 38. The center conductor 34 is spaced from the second conductive layer 22 so as to be electrically isolated therefrom. As shown in FIG. 2, the remote end 38 of the center conductor 34 is attached to the underside of the second leg 44 of the L-shaped conductive rod 41, thereby forming the short third leg 46 of the inverted F element 40.

The antenna assembly 10 can operate at two cellular telephone frequencies or two frequencies of N-WIFI. For N-WIFI, the first antenna section 16 may be tuned to operate at 2.4 GHz ISM band, while the second antenna section 18 tuned for the 5.0 GHz U-NII band. At those frequencies, each antenna section 16 and 18 is in essence electrically invisible to the other. Thus, for the first antenna section 16, the first conductive layer 21 acts as the ground plane and the second conductive layer 22 serves as the radiating element. The signal for the first antenna section 16, that is carried by the center conductor 34 of the coaxial cable 30, travels directly through the conductive rod 41 into the second conductive layer 22 exciting that layer to radiate the signal.

The inverted F element 40 acts as the radiating element of that second antenna section 18 and the second conductive layer 22 functions as the ground plane. In other words, at the higher signal frequency (e.g., 5.0 GHz), the structure of the first antenna section 16 is in essence invisible to the second antenna section 18 and the electrical coupling provided by the tuning post 29 makes the second conductive layer 22 appear as though it was connected directly to the shield conductor of the coaxial cable 30. Therefore, in the present antenna assembly 10, the second conductive layer 22 functions as the radiating element of the first antenna section 16 and as the ground plane for the second antenna section 18.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An antenna assembly comprising:

a first antenna section including a first electrically conductive layer that has a first surface area in a first plane, a second electrically conductive layer that has a second surface area in a second plane that is spaced from the first plane, a dielectric material between the first and second electrically conductive layers, and an electrical shunt connected to the first and second electrically conductive layers, wherein the first surface area is at least two times the second surface area;

a second antenna section comprising an inverted F element attached to the second electrically conductive layer; and a first electrical conductor and a second electrical conductor for carrying signals between the antenna assembly and a communication circuit, the first electrical conductor connected to the first electrically conductive layer and the second electrical conductor connected to the inverted F element.

2. The antenna assembly as recited in claim 1 wherein the first plane is parallel to the second plane.

3. The antenna assembly as recited in claim 1 wherein the dielectric material comprises a body having a first surface on which the first electrically conductive layer is mounted and a second surface on which the second electrically conductive layer is mounted.

4. The antenna assembly as recited in claim 3 wherein the body is disk shaped.

5. The antenna assembly as recited in claim 1 wherein the first surface area is more than four times the second surface area.

6. The antenna assembly as recited in claim 1 wherein the second electrically conductive layer has a tear-drop shape with an outwardly projecting tip, and the electrical shunt is located adjacent the tip.

7. The antenna assembly as recited in claim 1 wherein the inverted F element comprises a rod of electrically conductive material having an L-shape with a first leg and a second leg that is parallel to the second electrically conductive layer, wherein an end of the first leg is attached to the second electrically conductive layer, and wherein the second leg is longer than the first leg and has the second electrical conductor attached thereto.

8. The antenna assembly as recited in claim 1 wherein the first electrical conductor is attached to a center portion of the first electrically conductive layer, and the second electrical conductor extends through an aperture in a center region of the second electrically conductive layer.

9. An antenna assembly comprising:

a first antenna section having a substrate of dielectric material with first and second major surfaces, a first electrically conductive layer on the first major surface, a second electrically conductive layer on the second major surface and having a tear-drop shape with an outwardly projecting tip, and at least one electrical shunt located proximate to the tip of the second electrically conductive layer and attached to the first and second electrically conductive layers;

a second antenna section comprising an inverted F element having a rod of electrically conductive material that has a L-shape with a first leg and a second leg that is longer than the first leg, wherein an end of the first leg is directly connected to the second electrically conductive layer and the second leg is parallel to the second electrically conductive layer; and a transmission medium for carrying signals between the antenna assembly and a communication circuit, and comprising a first electrical conductor connected to the first electrically conductive layer and a second electrical conductor connected to the second leg.

10. The antenna assembly recited in claim 9 wherein the substrate is disk shaped.

11. The antenna assembly as recited in claim 9 wherein the substrate is a circular disk.

12. The antenna assembly as recited in claim 9 wherein an axis extends through a center of the first electrically conductive layer and through the second electrically conductive layer, the first leg is connected to the second electrically conductive layer at a point that is offset from the axis, and the second leg intersects the axis at a location where the second electrical conductor is connected to the second leg.

13. The antenna assembly as recited in claim 12 wherein the first electrical conductor is connected to the first electrically conductive layer adjacent the axis.

14. The antenna assembly as recited in claim 9 wherein the first and second electrically conductive layers are substantially centered on a common axis.

15. The antenna assembly as recited in claim 9 wherein the first major surface and the second major surface are parallel.

16. The antenna assembly as recited in claim 9 wherein the first electrically conductive layer has a first surface area against the first major surface, and the second electrically conductive layer has a second surface area against the second major surface, wherein the first surface area is at least twice the second surface area.

17. The antenna assembly as recited in claim 16 wherein the first surface area is more than four times the second surface area.

18. An antenna assembly comprising:

a first antenna section including a first electrically conductive layer in a first plane, a second electrically conductive layer in a second plane that is spaced from the first plane, a dielectric material between the first and second electrically conductive layers, and an electrical shunt connected to the first and second electrically conductive layers, wherein the second electrically conductive layer has a tear-drop shape with an outwardly projecting tip, and the electrical shunt is located adjacent the tip;

a second antenna section comprising an inverted F element attached to the second electrically conductive layer; and a first electrical conductor and a second electrical conductor for carrying signals between the antenna assembly and a communication circuit, the first electrical conductor connected to the first electrically conductive layer and the second electrical conductor connected to the inverted F element.

19. The antenna assembly as recited in claim 18 wherein the first electrically conductive layer has a first surface area in the first plane, and the second electrically conductive layer has a second surface area in the second plane, wherein the first surface area is at least twice the second surface area.

* * * * *